United States Patent [19]

Maier

[11] Patent Number: 4,603,376

[45] Date of Patent: Jul. 29, 1986

[54] TERMINAL ASSEMBLY FOR CIRCUIT BREAKER AND SIMILAR APPARATUS

[75] Inventor: Alfred E. Maier, Chippewa, Pa.

[73] Assignee: Westinghouse Electric Corp., Pittsburgh, Pa.

[21] Appl. No.: 622,316

[22] Filed: Jun. 19, 1984

[51] Int. Cl.[4] ..... H01R 9/03

[52] U.S. Cl. ..... 361/426; 200/284; 339/272 R; 339/272 UC; 361/355

[58] Field of Search ..... 174/73 R, 78, 84 R; 200/280, 281, 284; 339/272 R, 272 B, 272 UC; 361/353, 355, 361, 363, 376, 426

[56] References Cited

U.S. PATENT DOCUMENTS

| | | | |
|---|---|---|---|
| 2,285,928 | 6/1942 | Jensen | 200/284 |
| 2,732,535 | 1/1956 | Hammerly | 339/272 UC |
| 3,171,888 | 3/1965 | Stanback | 361/355 |
| 3,344,394 | 9/1967 | Kingsbury et al. | 339/272 R |
| 3,775,733 | 11/1973 | Ege | 339/272 R |
| 4,454,565 | 6/1984 | Krasij et al. | 361/376 |

FOREIGN PATENT DOCUMENTS

| | | | |
|---|---|---|---|
| 1227969 | 11/1966 | Fed. Rep. of Germany | 339/272 UC |
| 1447852 | 9/1976 | United Kingdom | 339/272 R |

*Primary Examiner*—A. D. Pellinen
*Assistant Examiner*—Greg Thompson
*Attorney, Agent, or Firm*—D. S. Buleza

[57] ABSTRACT

A terminal assembly for connecting a line cable to the bus conductor of a circuit interrupter or similar device by means of a locking screw that extends through the top wall of a metal lug component and clamps the inserted ends of the cable and bus conductor in overlapping relationship with each other and positive electrical contact with the bottom wall of the lug component. The bus conductor is held in slip-fitted interlocked position at the bottom of the lug component opening by the coaction of a pair of undercut grooves in the side walls of the lug component that accommodate the side edges of the bus conductor and cooperates with a coupling screw which extends through the bottom wall of the lug component and engages an unthreaded hole in the inserted end of the bus conductor. The lug component is fabricated from a block-like piece of extruded metal or, alternatively, from a piece of strap-like metal stock that is bent into hollow-rectangular form and provided with a pair of inturned arcuate tabs or inwardly protruding circular nibs that provide the same slip-fitting keyed fit with the inserted apertured end of the bus conductor.

14 Claims, 8 Drawing Figures

TERMINAL ASSEMBLY FOR CIRCUIT BREAKER AND SIMILAR APPARATUS

BACKGROUND OF THE INVENTION

This invention relates generally to electric connectors and, more particularly, to an improved terminal assembly for connecting the bus conductor of a circuit braker or other device to an external line cable.

As is well known in the art, circuit breakers and similar devices such as switches require a reliable and economical terminal means for connecting the bus conductor of the circuit interrupter or switch to an electric cable which comprises part of the line circuit which is being protected from overload conditions or must be isolated for other reasons. Prior art terminal structures generally consisted of a metal lug that had a pair of screws disposed in tapped holes provided in the top and bottom walls of the lug and adapted to engage a tapped hole in the inserted end portion of the bus conductor to secure the latter to the lug and then permit the inserted end of the line cable to be clamped in overlapping electrical contact with the bus conductor when the second screw was tightened. In other prior art connector arrangements a terminal lug (or clip) was mounted on top of the bus conductor by means of a screw that passed through a hole in the bus conductor and engaged a tapped hole in the terminal lug, thus fastening the bus conductor to the bottom of the terminal lug.

In another prior art design, the terminal lug consisted of a U-shaped body member having a hinged L-shaped support that was fitted with a locking screw and rotatable retaining means which permitted the line conductor to be inserted downwardly into the body member and then clamped in place against the bus conductor anchored at the bottom of the body member. A terminal assembly of this type is disclosed in U.S. Pat. No. 3,559,156 issued Jan. 26, 1971 to K. R. Coley.

In accordance with a more recent development in the art, the terminal lug is coupled to the apertured end of the bus conductor by a U-shaped retaining clip that is force-fitted over the end of the bus conductor and bottom wall of the terminal lug after the bus conductor has been inserted into the lug and slipped over a boss that protrudes from the bottom wall of the lug and engages the opening in the bus conductor. A clip-connected terminal lug assembly which embodies this design and includes a terminal screw that extends through the top wall of the lug and forces the inserted end of the electric cable against the clip-anchored bus conductor is disclosed in U.S. Pat. No. 3,891,298 issued June 24, 1975 to N. Yorgin et al.

While the prior art connector structures and terminal assemblies were satisfactory from the standpoint of effecting the electrical juncture of the bus conductor and line cable by mechanical means which permitted the line cable to be connected and disconnected from the bus conductor of a circuit interrupter or switch which has been mounted on a control panel or the like, they had various inherent disadvantages from both a functional and cost standpoint. The use of screws to fasten a tapped bus conductor to the inner or outer face of the bottom wall of the terminal lug, for example, made it difficult to make such a connection—particularly when a molded-case type circuit breaker is involved and the terminal assembly is recessed within a portion of the breaker case and there is very little room for threadably coupling the screw to both the terminal lug and bus conductor. The use of metal clips or nuts inside the terminal lug to anchor the bus conductor to the lug interfered with or prevented clamping the inserted ends of the bus conductor and electric cable in direct contact with one another with the result that high resistance areas in the terminal connection sometimes occurred which were undesirable from a functional and safety standpoint. Fastening the bus conductor to an exterior part of the terminal lug by means of a screw or other member is also undesirable since this arrangement makes the lug a current-carrying part of the electric circuit.

Another disadvantage encountered with the use of terminal assemblies having screws which engaged a tapped hole in the bus conductor was the necessity of using bus conductors which were thick enough to provide a sufficient number of threads to avoid stripping them during the conductor-coupling operation. The prior art terminal lugs also have openings of such configuration that the cable conductor can gradually loosen from its clamped position after it has been heated and cooled a number of times, particularly when the cable is of the multi-strand type.

The provision of a terminal assembly which would permit the bus conductors of circuit interrupters, switches and similar devices to be clamped directly to the line cable in a simple and expedient manner with a minimum number of parts that not only eliminate the need for a tapped hole in the bus conductor but ensures that the line cable remains firmly clamped in direct positive contact with the bus conductor under both normal and adverse operating conditions would constitute a useful improvement in the art from both a cost and quality standpoint.

SUMMARY OF THE INVENTION

In accordance with the present invention, the aforementioned problems are avoided and the stated objectives are achieved by providing a terminal assembly having a lug component that is so contoured that it provides integral means which cooperates with a coupling screw in the bottom wall of the lug to retain the inserted end of the bus conductor at the bottom of the lug opening, prior to the insertion of the line cable, and then ensures that the cable remains in tightly clamped direct contact with the bus conductor. In contrast to some of the prior art terminal designs, the bus conductor is provided with an unthreaded rather than a threaded hole which is slightly larger than the inwardly protruding tip of a coupling screw that extends through the bottom wall of the lug component so that the screw tip merely serves as a "post means" for holding the bus conductor in the proper lateral position within the terminal lug.

In accordance with a preferred embodiment of the invention, the terminal lug is formed from a block-like piece of extruded metal and complete retention of the apertured bus conductor in its inserted position within the lug component and interlocked relationship with the tip of the coupling screw is achieved by a pair of undercut grooves in the side walls of the lug that extend along the edges of the bottom wall and, together with such wall, define a slot-like passageway that receives the end portion of the bus conductor in snug slip-fitting fashion and prevents it from slipping off the tip of the coupling screw. To facilitate the proper orientation of the inserted bus conductor within the terminal lug, the end portion of the bus conductor may also be provided with laterally protruding shoulders which seat against the grooved portions of the lug during insertion of the bus conductor and thereby serve as stop means which automatically aligns the hole in the bus conductor with the threaded shaft of the coupling screw and permits the latter to be easily advanced into keyed interlocking relationship with the bus conductor.

The inserted electric line cable is securely clamped in direct contact with the inserted end of the bus conductor by a locking screw that extends through a tapped aperture in the top wall of the terminal lug and forces the cable against the end of the bus conductor retained at the bottom of the lug opening. If the relative sizes of the electric cable and terminal lug opening are such that loosening of the cable from its clamped position might occur as a result of heating and cooling of the cable during operation of the electric circuit, or such loosening occurs because the cable is of the multi-strand type and is thus readiy distorted from its round configuration as a result of the clamping action of the locking screw, integral means may also be provided in the improved terminal assembly for preventing such loosening and a faulty electrical connection. In a preferred embodiment, this is achieved by shaping the inner contour of the lug component in such a manner that the inner side wall surfaces of the lug which are adjacent to and merge with the undercut grooves are of arcuate cross-sectional configuration and define a pair of inwardly flared fillets that extend along the respective grooves and provide the bottom portion of the lug component opening with a substantially rounded profile. The lug thus nestingly receives and provides a solid support for the line cable and ensures that it remains in firmly clamped contact with the underlying bus conductor.

In accordance with an alternative embodiment, the terminal lug is formed from a piece of strap-like metal stock that is bent into open-rectangular shape and held in this form by a hollow-like metal rivet fastner that extends through holes provided in the overlapped end segments of the metal stock and is anchored in place by flattening the protruding end of the fastener into a collar. The interior of the rivet-like fastener is threaded and thus accommodates the locking screw. Portions of the side walls of the lug component are deformed and punched inwardly to provide a pair of protruding tabs or nibs which are so spaced from the bottom wall of the lug that they serve as the means for retaining the inserted end of the bus conductor in place when it is key-interlocked with the tip of the coupling screw provided on the bottom wall.

BRIEF DESCRIPTION OF THE DRAWINGS

A better understanding of the invention will be obtained from the exemplary embodiments illustrated in the accompanying drawings, wherein.

DESCRIPTION OF THE PREFERRED EMBODIMENTS

Figure 1:
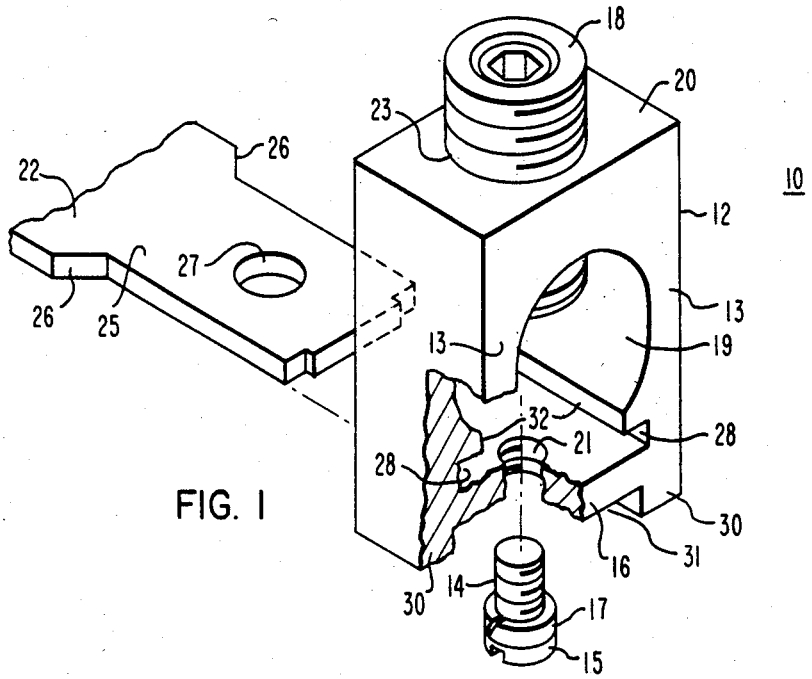
FIG. 1 is an exploded perspective view of a terminal assembly and associated end portion of a bus conductor constructed in accordance with a preferred embodiment.

While the invention can be used for connecting line or power cables to various kinds of devices such as switches and the like used in the electric power industry, it is especially adapted for use in conjunction with circuit interrupters and it has accordingly been so illustrated and will be so described.

Referring now to the drawings and FIGS. 1–3 in particular, there is shown a terminal assembly 10 comprising a terminal lug component 12 having a coupling screw 14 provided on its bottom wall 16 and a locking screw 18 provided on its top wall 20 which cooperate in the manner hereinafter described to connect an electric bus conductor 22 of the circuit interrupter to the stripped end portion of an electric cable conductor 24 (shown in phantom outline in FIG. 3) of the circuit being protected. The terminal lug component 12 has a pair of side walls 13 which, together with the bottom wall 16 and top wall 20, constitute the body of the lug component 12 and define a lug opening 19 that is adapted to receive the inserted end portions of the bus conductor 22 and line cable 24. The coupling screw 14 extends through a threaded aperture 21 formed in the bottom wall 16 of the lug component 12 and is of such length that only the tip of the screw shaft protrudes into the lug opening 19 a predetermined distance when the head 15 of the screw 14 and a lock washer 17 are seated against the outer face of the bottom wall 16. The locking screw 18 is disposed in a second threaded aperture 23 provided in the top wall 20 and extends into the lug opening 19 a distance sufficient to engage and force the inserted end of the cable conductor 24 in to positive overlapped electrical contact with the end of the bus conductor 22 disposed in overlying relationship with the end wall 16 of the lug component.

Figure 2:
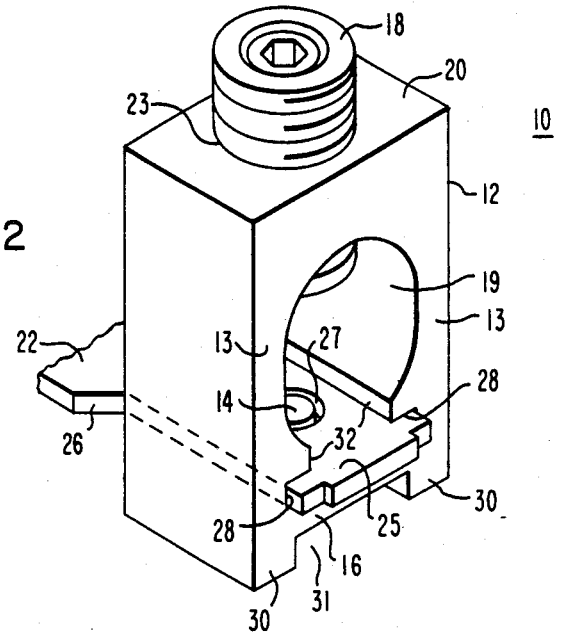
FIG. 2 is a perspective view similar to FIG. 1 with the terminal lug coupled to the slip-fitted key-locked bus conductor.

As will be noted more particularly in FIGS. 1 and 2, the bus conductor 22 is of uniform thickness and has an end portion 25 that is provided with hole 27 and is of generally flat rectangular configuration and reduced width compared to the main body portion of the bus conductor. This width difference provides a pair of tapered laterally extending shoulders 26 which, if desired, can be employed as stop means for automatically controlling the lateral position of the bus conductor 22 when it is inserted into the lug component 12 and thereby aligning the unthreaded hole 27 with the threaded aperture 21 and the coupling screw 14 when the bus conductor 22 is in its fully inserted position.

An important feature of the invention is the manner in which the interior of the terminal lug 12 is contoured to provide integral means for holding the inserted end portion 25 of the bus conductor in interlocked relationship with the tip of the coupling screw 14. As will be noted in FIGS. 1–3, this is achieved by providing the inner side walls of the lug component 12 with a pair of undercut grooves 28 that extend along the bottom wall 16 of the lug and, together with the bottom wall, defines a slot-like passageway that is dimensioned to snugly receive the end portion 25 of the bus conductor 22 in slip-fitting fashion. The inserted bus conductor 22 is thus prevented from moving in a vertical direction by the undercut grooves 28 and is restrained from lateral movement by the loose interlocking fit between the tip of the coupling screw 14 and hole 27 in the conductor end portion 25 with the result that the bus conductor 22 is securely held in its inserted position within the terminal lug 12.

Prior to the insertion of the bus conductor 22 into the lug 12, the coupling screw 14 is partially threaded into aperture 21 a distance such that its tip does not extend beyond the bottom wall 16 of the lug and thus will not interfere with the smooth insertion of the bus conductor end portion 25 into the slot-like passageway provided by the undercut grooves 28. Interlocking of the inserted bus conductor 22 and lug component 12 is thus very readily accomplished by simply rotating the coupling screw 14 the small number of turns necessary to seat its head 15 and locking washer 17 against the outer face of the bottom wall 16 and advance its tip into the aligned hole 27 of the inserted bus conductor end portion 25. The tip of the coupling screw 14 accordingly merely serves as a boss or "post" means that loosely engages and interlocks with the bus conductor hole 27.

Figure 3:
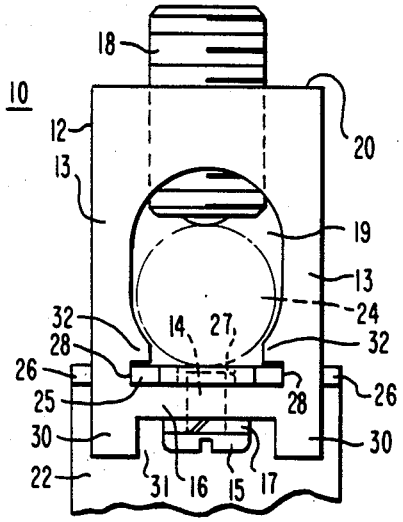
FIG. 3 is an end view of the coupled terminal assembly and bus conductor shown in FIG. 2, the inserted end of the electric line cable being shown in phantom outline to illustrate its location.

As will be noted in FIG. 2 and more particularly in FIG. 3, the length of the threaded shaft of the coupling screw 14 is such that the tip of the screw is flush with or slightly recessed beneath the top face of the bus conductor end portion 25 when the bus conductor 22 is in interlocked position at the bottom of the lug opening 19. The tip of the screw 14 accordingly does not interfere in any way with the direct overlapping contact between the inserted ends of the bus conductor 22 and electric line cable 24 effected by the locking screw 18 when it is tightened by a suitable tool.

Another important feature of the present invention is the provision of a "built-in" safeguard against the potential problem that the lug component 12 might be inadvertently mounted on top of the bus conductor 22 by coupling the bus conductor end portion 25 to the bottom face of the end wall 16 of the lug component 12 with the coupling screw 14 and its lock washer 17. This problem is conveniently avoided by fabricating the lug component 12 in such a way that the side walls 13 extend beyond the end wall 16 distances sufficient to provide a pair of downwardly-extending parallel leg portions 30 that define, together with the outer face of the end wall 16, a shallow channel 31 that extends along the bottom of the lug 12. As shown most clearly in FIG. 3, the width dimension of the shallow channel 31 is much smaller than the width dimension of the slot-like passageway provided by the undercut grooves 28 and is also smaller than the width dimension of the bus conductor end portion 25. It is accordingly physically impossible to slip the bus conductor end portion 25 into the lug channel 31 and couple it to the outer face of the end wall 16 instead of inserting it into the lug component 12 in keyed slip-fitting relationshp with the slot-like passageway provided at the bottom of the lug opening 19.

As will also be noted in FIG. 3, the depth of the shallow lug channel 31 is sufficient to protectively recess the head 15 of the coupling screw 14 and its lock washer 17 within the confines of the lug component 12 when the coupling screw in its seated position.

In the preferred embodiment shown in FIGS. 1–3, the lug component 12 is provided with an additional feature which ensures that the inserted end of the line cable 24 remains clamped in positive overlapped electrical contact with the bus conductor end portion 25 even though the connection is subjected to heating and cooling cycles or vibration during operation of the electrical circuit and its protective apparatus. This additional feature is provided by contouring the inner side wall portions of the lug component 12 in the region adjacent the undercut grooves 28 in such a manner that the walls in this region are of arcuate cross-sectional configuration and provide a pair of inwardly flared fillets 32 that terminate at and merge with the respective grooves 28 and provide the bottom portion of the lug component opening 19 with a substantially rounded profile. As shown most particularly in FIG. 3, this rounded profile of the bottom portion of the lug component opening 19 provides a nest-like interfit between the cable 24 and lug component 12. In the case of a line cable 24 that is made from a plurality of strands, the resulting firm nesting support provided by the lug fillets 32 prevents the cable strands from creeping into the corners of the lug opening 19 when the electric cable 24 is heated and cooled during operation of the electrical circuit and its associated apparatus, or when the cable is pull-tested for secureness. The terminal assembly 10 shown in FIGS. 1–3 is accordingly especially adapted for use with circuit breakers and multi-strand line cables that have current ratings in the 100 to 400 ampere range.

In this particular embodiment, the terminal lug component 12 was fabricated from a single block-like piece of metal, such as extruded aluminum, and can thus be readily manufactured in various sizes to connect bus conductors and electric cables designed for the aforementioned range of current-carrying capacity.

Figure 4:
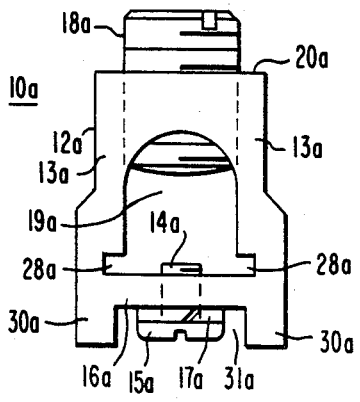
FIG. 4 is an end view of an alternative embodiment of a terminal lug assembly in accordance with the invention that is adapted for use with line cables of smaller size.

The invention is not limited to such "heavy duty" terminal lug components that have inwardly flared fillets, however, and includes within its scope smaller size lug components that have openings of a different configuration adapted to snugly receive line cables having a small number of strands (or which comprise a solid wire) and carry currents in the 10 to 100 ampere range. A terminal assembly **10*a* designed for such lower current ratings and having a lug component 12*a* with a modified opening 19*a* is shown in FIG. 4. As illustrated, the configuration of the inner surfaces of the side walls 13*a* and top wall 20*a* are such that the top portion of the lug opening 19*a* is of arcuate cross-sectional contour and merges with flat side wall surfaces which, in turn, merge with the pair of opposing undercut grooves 28*a* at the bottom wall 16*a*. While a lug opening 19*a* of this shape does not provide the curved nesting-support relationship with the bottom portion of the inserted line cable (not shown) achieved in the previous embodiment, the fact that the inserted end portion of the bus conductor (not shown) extends completely across the bottom of the lug opening 19***a* and is exposed ensures that a positive and reliable electrical connection will be made with the line cable when the latter is inserted and the locking screw 18*a* is tightened and properly seated against the cable.

As in the embodiment shown in FIGS. 1–3, the terminal lug 12*a* is provided with a pair of downwardly-extending legs 30*a* that define a shallow exterior channel 31*a* which is narrower than the slot-like passageway provided by the undercut grooves 28*a* and bottom wall 16*a*. The channel 31*a* is, however, deep enough to protectively recess the head 15*a* and lock washer 17*a* of the seated coupling screw 14*a*. As will be noted, the tip of the coupling screw 14*a* protrudes just a short distance into the lug opening 19*a* so that it will engage the hole in the inserted end portion of the bus conductor without extending beyond the bus conductor and thus interfering with the intimate overlapping fit of the line cable with the bus conductor when the locking screw 18*a* is tightened into clamping position.

Figure 5:
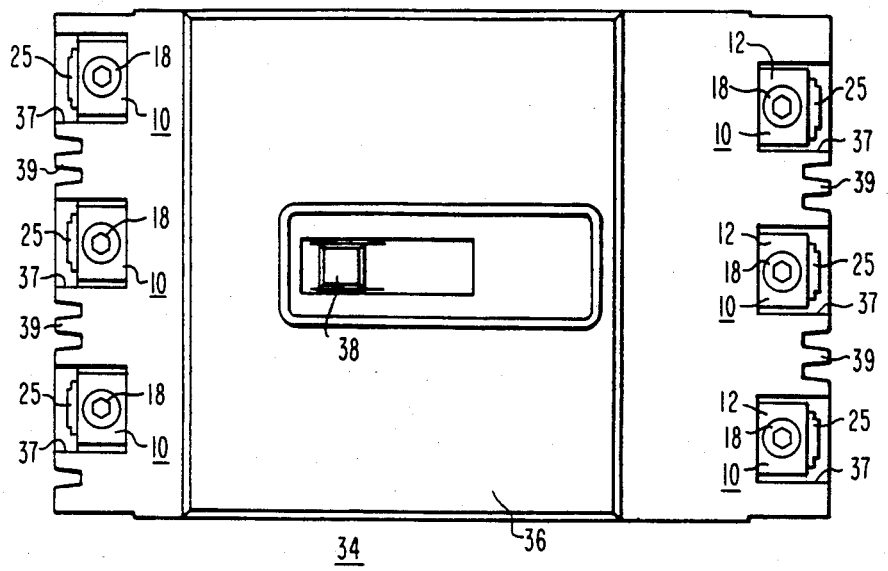
FIG. 5 is a top plan view of a molded-case type circuit breaker showing a series of recessed terminal asseblies fastened to the respective bus conductors of the breaker and ready for connection to the stripped ends of the electric line cables.
Figure 6:
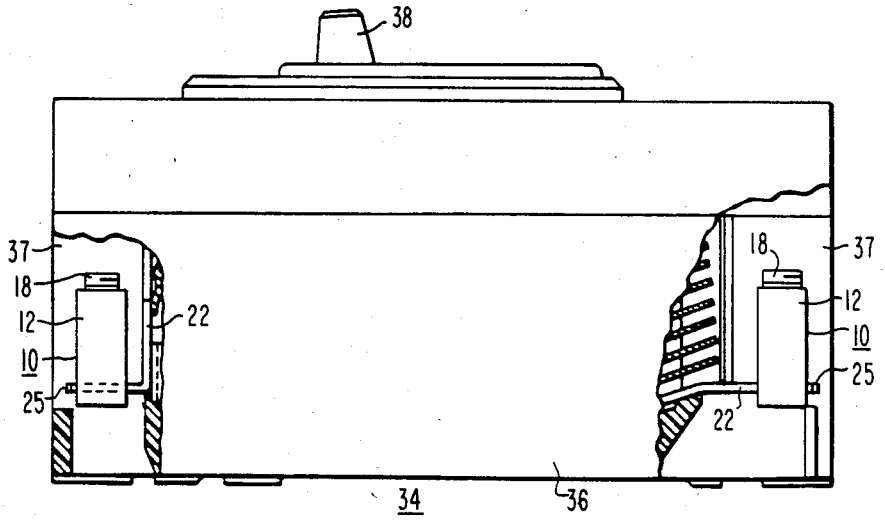
FIG. 6 is a side elevational view of the circuit breaker shown in FIG. 5, end portions of the molded-case enclosure being broken away to show the relationship of the recessed terminal assemblies and their attached bus conductors.

The terminal lug assemblies 10 and 10*a* are particularly suitable for use on a circuit breaker 34 of the molded-case type shown in FIGS. 5 and 6. For a three-phase circuit breaker 34 with connections on the line and load sides, six terminal assemblies 10 are required per breaker. The line cables (not shown) to be connected to the circuit breaker 34 are inserted endwise into the respective terminal lugs 12 which have been previously coupled to the inserted ends 25 of the respective bus conductors 22 that are connected to a pair of separable contacts (not shown) located within the breaker housing 36 that is composed of suitable insulating material. The circuit breaker 34 is manually operated to close and open position by manipulating an actuating lever 38 that extends from the breaker housing 36 and the breaker is designed to be automatically tripped open in response to undercurrent loads by the operation of an internal trip device (not shown). The details of the operating mechanism and trip device is disclosed in U.S. Pat. Nos. 3,480,900 and 3,492,614, both of which are assigned to the same assignee as the present invention.

As will be noted in FIGS. 5 and 6, each of the bus conductors 22 extend from the breaker housing 36 and are located within a series of small cavities or recesses 37 that are separated from each other by insulating baffles 39 and are large enough to accommodate the respective terminal lug assemblies 10 and permit the lugs 12 to be coupled to the bus conductor end portions 25 and then be readily accessible for insertion of the line cables and tightening of the respective locking screws 18. Suitable openings in the breaker housing 36 are provided to permit tightening of the coupling and locking screws of the terminal lug assemblies 10 by proper tools. Entry of the line cables into the lug openings is aided by the lips of the respective bus conductor end portions 25 which protrude beyond the sides of the lug components 12.

Figure 8:
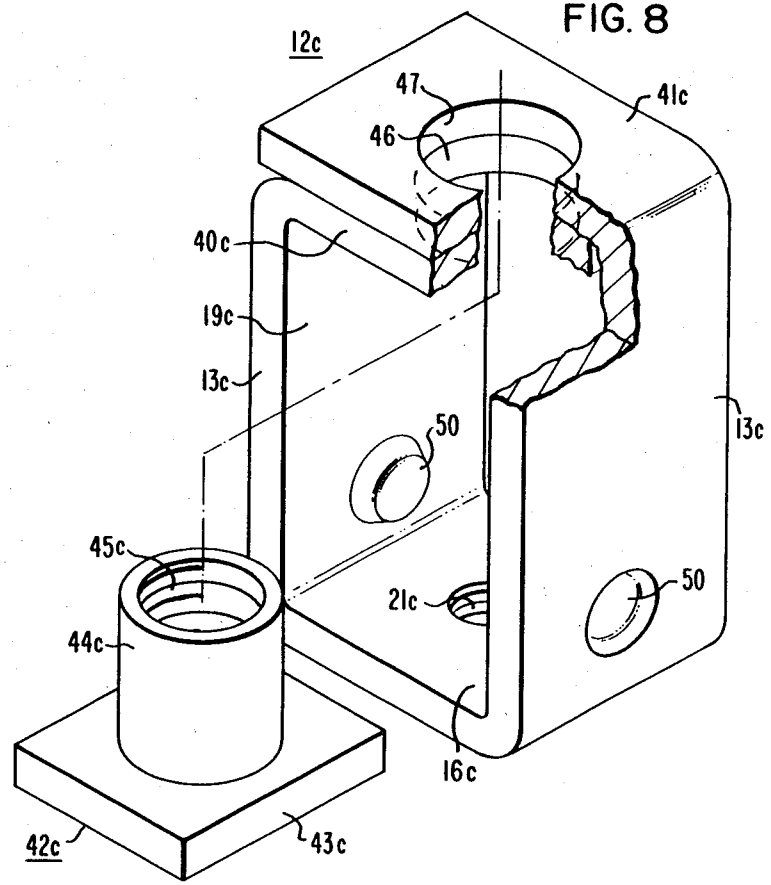
FIG. 8 is an exploded view of a modified terminal lug component similar to that shown in FIG. 7 and illustrating in greater detail the structure of the rivet-like fastening member and the manner in which it is inserted into the apertured overlapped end segments of the lug material.
Figure 7:
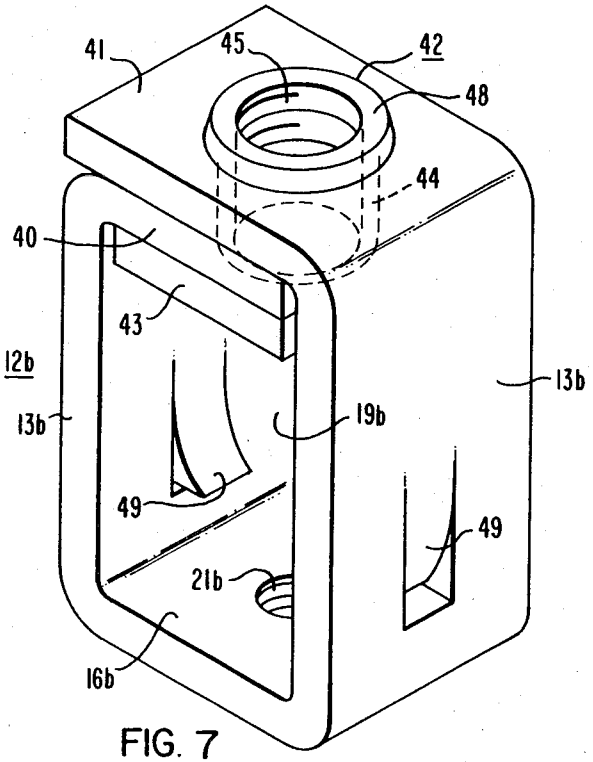
FIG. 7 is an enlarged perspective view of a terminal lug component in accordance with another alternative embodiment of the invention, the coupling and locking screws being omitted for clarity of illustration.

Alternative embodiments of terminal lugs 12*b* and 12*c* according to the invention are illustrated in FIGS. 7 and 8, respectively. In accordance with the FIG. 7 embodiment, the lug 12*b* is not manufactured from a solid extruded piece of metal but is formed from a single piece of strap-like metal stock (such as copper, stainless steel or aluminum) that is bent into generally hollow-rectangular form to provide a pair of side walls 13*b*, a bottom wall 16*b* and a top wall formed by the overlapped ends 40, 41 of the metal stock. The lug opening 19*b* is accordingly also of generally rectangular cross-section and the overlapped ends 40, 41 of the metal stock are locked in such position by a hollow rivet-like metal fastener 42 which has a rectangular head portion 43 that is disposed within the lug opening 19*b* in lapped relationship with the lug end segment 40 so that the cylindrical shaft portion 44 of the fastener 42 extends upwardly through a pair of aligned openings 46, 47 (see FIG. 8) in the end segments. The shaft portion 44 is of such length that it projects beyond the outer face of end segment 41 so that it can be deformed by a suitable tool into a flange or collar 48 which is seated against end segment 41 and thus locks the fastener 42 in place. The inner surface of the fastener shaft 44 is tapped and thus serves as the threaded aperture 45 which accommodates the locking screw (not shown). A threaded aperture 21*b* is also provided in the bottom wall 16*b* for the coupling screw (also not shown).

In accordance with the FIG. 7 embodiment, the undercut grooves which provide the slot-like key passageway for the inserted end of the bus conductor in the FIGS. 1∝4 embodiments is replaced by a pair of arcuate spring-like tabs 49 that are coined from the respective side walls 13*b* and are pushed inwardly into the lug opening 19*b*, as shown. The distance between the inner surface of the end wall 16*b* and the bottom faces of the respective tabs 49 is preferably made slightly larger than the thickness of the side edges of the inserted end of the bus conductor so that the bus conductor can be slipped into the bottom of the lug component 12*b* under the tabs 49 and then be held in place by the coupling screw when it is seated on the bottom wall 16*b* with its tip engaging the loose-fitting holein the inserted bus conductor end portion.

The lug component 12*c* shown in FIG. 8 is manufactured in the same manner as the FIG. 7 embodiment and is structurally identical except that the side walls 13*c* are locally deformed by suitable punch means to form a pair of circular nibs 50 that protrude into the lug opening 19*c* and are located the proper distance from the bottom wall 16*c* to slidingly accommodate in slip-interfitting fashion the inserted end of the bus conductor in the same manner as the inturned tabs 49 of the FIG. 7 embodiment. The bottom wall 16*c* is provided with a threaded aperture 21*c* which is adapted to receive the coupling screw (not shown). A full view of the rivet-like fastener 42*c* is shown in this Figure and the exploded illustration of the lug 12*c* also discloses in greater detail the manner in which the fastener shaft 44*c* is inserted into the aligned snug-fitting holes 46, 67 of the lug end segments 40*c*, 41*c* to secure the stock metal in lug form.

It will be appreciated by those skilled in the art that even though the FIGS. 7 and 8 embodiments of the terminal assembly are manufactured in a completely different manner from that employed in the FIGS. 1–4 embodiments, the coaction of the coupling screw and the lug tabs or nibs still provide the same bus conductor coupling feature which permits the bus conductor to be retained in assembled relationship with the terminal lug at the bottom of the lug opening in a simple and effective manner so that the line cable can subsequently be inserted into the lug component and then clamped in direct overlapping positive electrical contact with the bus conductor by simply tightening the locking screw on the top of the lug component.

I claim:

1. A terminal assembly which connects an electric cable conductor to a bus conductor that has a substantially flat end portion with an unthreaded hole therein, said terminal assembly comprising;

a lug component having an opening therethrough receiving the end portion of said cable conductor and the substantially flat end portion of said bus conductor in overlapped relationship, said opening being defined by a top wall, a bottom wall, and a pair of side walls which constitute the body of said lug component, a first threaded aperture extending through the bottom wall of said lug component, a coupling screw having a head portion and a shaft that is in threaded engagement with and extends through said first threaded aperture and is of such length that only the tip thereof protrudes into said opening of said lug component and thereby serves as a post means which engages the unthreaded hole in the end portion of said bus conductor, said bus conductor being placed in said lug component opening on top of the bottom wall thereof and the head of the coupling screw contacting and seating against the outer face of said bottom wall, the tip of the coupling screw being smaller than the unthreaded hole in the end portion of said bus conductor and thereby effecting a loose interlocking fit with said bus conductor, a second threaded aperture extending through the top wall of said lug component, a locking screw extending through said second aperture and tightened to force the end portion of said cable conductor disposed in said lug component opening into positive overlapping electrical contact with the end portion of said bus conductor disposed in said opening at the bottom thereof and thereby securely clamp said conductors to each other and said lug component, and means integral with the side walls of said lug component holding the end portion of said bus conductor in overlapping position on the bottom wall of said lug component and in loosely interlocked relationship with the tip of the seated coupling screw prior to the placement of said cable conductor in said lug component opening and the subsequent tightening of the locking screw.

2. The terminal assembly of claim 1 wherein said bus conductor holding means comprises a pair of undercut grooves in the side walls of the lug component that extend along the edges of the bottom wall and together therewith define a passageway of slot-like configuration that receives the end portion of said bus conductor in slip-fitting relationship.

3. The terminal assembly of claim 2 wherein the side walls of said lug component have inner surfaces and the portions of the inner surfaces of the side walls that are adjacent to and merge with the respective undercut grooves are of arcuate cross-sectional configuration and define a pair of inwardly flared fillets that terminate at the respective undercut grooves and provide the bottom portion of said lug component opening with a substantially rounded profile.

4. The terminal assembly of claim 2 wherein the top wall and side walls of said lug component have inner surfaces that are of such configuration that the portion of said lug component opening that is defined by the top wall and adjoining portions of the side walls is of arcuate profile and merges with other portions of the side walls that are substantially flat and extend to and merge with the respective undercut grooves at the bottom of said lug component opening.

5. The terminal assembly of claims 2, 3 or 4 wherein;

the head portion of the coupling screw is fitted with a lock washer, said lug component is fabricated from a single block-like piece of metal, and the side wals of said lug component extend beyond the bottom wall thereof and comprise a pair of spaced leg portions that define an exterior shallow channel at the bottom of said lug component that is of sufficient width and depth to accommodate the head portion of the coupling screw and said lock washer but is narrower than the passageway of slot-like configuration at the bottom of said lug component opening and thereby protectively recesses the washered head portion of the coupling screw and prevents the end portion of said bus conductor from being inadvertently placed into the shallow channel and fastened to the outer face of said lug component by the washered coupling screw.

6. The terminal assembly of claim 1 wherein said bus conductor has side edge portions of predetermined thickness and said bus conductor holding means comprises a pair of inwardly extending protuberances that constitute locally deformed portions of the side walls of said lug component and are both spaced from the bottom wall of said lug component a distance slightly greater than the thickness of the side edge portions of the bus conductor end portion which is received by said lug component.

7. The terminal assembly of claim 6 wherein;

said lug component is of generally hollow-rectangular configuration and is formed from a single piece of strap-like metal stock that is bent into such configuration and has two end segments that are disposed in overlapped relationship and provided with unthreaded holes that are aligned with one another, and the end segments of said piece of metal stock are held in said overlapped relationship by a hollow rivet-like metal fastener that has a shaft portion which extends upwardly through the aligned holes in the overlapped end segments of the metal stock and is terminated by an integral collar of deformed metal that anchors the fastener in place, the interior surface of the hollow shaft portion of said rivet-like fastener being threaded and thereby constituting the threaded aperture for the locking screw.

8. In combination with a circuit interrupter that has a housing of insulating material and is adapted to protect an electric circuit from current overloads and the like, a bus conductor having an end portion that has an unthreaded hole therein and extends from said housing, and a terminal assembly fastened to said end portion of said bus conductor and facilitating the connection of the circuit interrupter to an end portion of an electric cable conductor that comprises part of the electric circuit being protected, said terminal assembly comprising;

a lug component having a top wall, a bottom wall and a pair of side walls that define an opening through said lug component, said end portion of said bus conductor being disposed in said opening in overlapped relationship with the bottom wall of said lug component, a first threaded aperture extending through the bottom wall of said lug component and aligned with the unthreaded hole in the said end portion of said bus conductor, a coupling screw in threaded engagement with and extending through said first threaded aperture and having a head portion that is in contact with and seated against the outer face of the bottom wall of said lug component, the coupling screw being of such length and size that only the tip thereof extends into the aligned unthreaded hole in the said end portion of said bus conductor and effects a loose interlocking fit with said bus conductor, said bus conductor end portion being of such thickness that the tip of the coupling screw does not protrude beyond said bus conductor into said lug component opening, means integral with the side walls of said lug component holding the said end portion of said bus conductor within said lug component opening in loosely interlocked relationship with the tip of the coupling screw and in overlapped position on the bottom wall of said lug component.

a second threaded aperture extending through the top wall of said lug component, a locking screw extending through said second threaded aperture and tightened to force the end portion of said cable conductor inserted into said lug component opening into positive overlapping electrical contact with the interlocked end portion of said bus conductor that is held at the bottom of said lug component opening and thereby securely clamp said conductors to each other and said lug component.

9. The combination of a circuit interrupter and a terminal assembly according to claim 8 wherein;

the said end portion of said bus conductor is substantially flat and has substantially straight parallel side edges, and said bus conductor holding means comprises a pair of undercut grooves in the side walls of said lug component that extend along the edges of the bottom wall and together therewith define a passageway of slot-like configuration that receives the said substantially flat end portion of said bus conductor in slip-fitting relationship.

10. The combination of a circuit interrupter and a terminal assembly according to claim 9 wherein;

the electric cable conductor is of multi-strand construction and substantially round cross-section, and the portions of the side walls of said lug component that are adjacent to the respective undercut grooves have inner surfaces that are of arcuate cross-sectional configuration and define a pair of inwardly flared fillets that terminate at and merge with the respective grooves and provide the bottom portion of said lug component opening with a substantially rounded profile, whereby said lug component nestingly receives and is clamp-connected to the multi-strand cable conductor and the underlying end portion of said bus conductor.

11. The combination of a circuit interrupter and a terminal assembly according to claim 9 or 10 wherein;

the head portion of the coupling screw is fitted with a lock washer, said lug component is fabricated from a single block-like piece of metal and has side walls which extend beyond the bottom wall and comprise a pair of spaced leg portions that define an exterior shallow channel at the bottom of said lug component that is of sufficient width and depth to accommodate the head portion of the coupling screw and said lock washer but is narrower than said substantially flat end portion of said bus conductor and thereby prevents said bus conductor from being inadvertently inserted into the shallow channel and fastened to the outer face of said lug component by the coupling screw and said lock washer.

12. The combination of a circuit interrupter and a terminal assembly according to claim 8 wherein;

said lug component is formed from a single piece of strap-like metal stock that has two end segments and is bent into generally hollow-rectangular configuration and thus defines an opening that is also generally rectangular in configuration, the end segments of said metal stock being disposed in overlapped relationship and provided with a pair of unthreaded holes that are aligned with one another, and the end segments of said piece of bent metal stock are held in said overlapped relationship by a hollow rivet-like metal fastener that has a shaft portion which extends upwardly through the aligned holes in the overlapped end segments of said metal stock and is terminated by an integral collar of deformed metal that anchors the hollow rivet-like metal fastener in place, the interior surface of the hollow shaft portion of said rivet-like fastener being threaded and mated with the locking screw.

13. The combination of a circuit interrupter and a terminal assembly according to claim 12 wherein the bus conductor holding means comprises a pair of inwardly protruding spring-like tabs that comprise oppositely-disposed inturned portions of the side walls of said lug component and are spaced from the bottom wall of said lug component a distance slightly greater than the thickness of the side edge portions of said bus conductor which are slip-fitted therebeneath.

14. The combination of a circuit interrupter and a terminal assembly according to claim 12 wherein the bus conductor holding means comprises a pair of inwardly protruding nibs that comprise oppositely-disposed locally-deformed portions of the side walls of said lug component and are spaced from the bottom wall of said lug component a distance slightly greater than the thickness of the side edge portions of said bus conductor which are slip-fitted therebeneath.

* * * * *